US005165967A

United States Patent [19]

Theno et al.

[11] Patent Number: 5,165,967

[45] Date of Patent: Nov. 24, 1992

[54] METHOD FOR PRODUCING ARTICLE WITH DIFFERENT GLOSS SURFACES

[75] Inventors: Mark H. Theno, Owatonna; James M. Alexander, Waseca; Dennis Kuefner, Waseca; Timothy Hansen, Waseca, all of Minn.

[73] Assignee: Brown Printing Co., a division of Gruner & Jahr Publishing Co.

[21] Appl. No.: 672,024

[22] Filed: Mar. 19, 1991

Related U.S. Application Data

[63] Continuation-in-part of Ser. No. 586,879, Sep. 24, 1990, abandoned.

[51] Int. Cl.[5] ..... B05D 3/02; B05D 3/12; B05D 5/02

[52] U.S. Cl. ..... 427/264; 427/265

[58] Field of Search ..... 427/261, 264, 265, 266, 427/257, 270

[56] References Cited

U.S. PATENT DOCUMENTS

| | | | |
|---|---|---|---|
| 2,000,347 | 5/1935 | Murray | 428/203 |
| 2,230,876 | 2/1941 | Wysong | 428/204 |
| 2,696,168 | 12/1954 | Costello | 101/424.2 |
| 2,974,058 | 3/1961 | Pihl | 427/158 |
| 3,218,183 | 11/1965 | Fritzsching et al. | 427/158 |
| 4,029,831 | 6/1977 | Daunheimer | 427/264 |
| 4,170,681 | 10/1979 | Edwards | 428/205 |
| 4,187,131 | 2/1980 | Shortway et al. | 427/264 X |
| 4,217,378 | 8/1980 | Pizur, Sr. | 427/259 |
| 4,464,423 | 8/1984 | LaBianca et al. | 427/265 X |
| 4,839,200 | 6/1989 | Hoffman et al. | 427/265 |
| 4,871,609 | 10/1989 | Suzuki et al. | 428/195 |
| 4,916,007 | 4/1990 | Manning et al. | 428/203 |

*Primary Examiner*—Evan Lawrence
*Attorney, Agent, or Firm*—Jacobson & Johnson

[57] ABSTRACT

A method for producing an ink-printed article with two different and discrete gloss finishes by using inks with different drying times and then applying an acrylic coating to article covered with the inks prior to the complete drying of one of the inks but after the substantial drying of the other ink to produce an article where the surface of the article has at least two different and discrete finishes, wherein the glossier finish corresponds to the faster drying ink.

9 Claims, 2 Drawing Sheets

METHOD FOR PRODUCING ARTICLE WITH DIFFERENT GLOSS SURFACES

CROSS REFERENCE TO RELATED APPLICATIONS

This application is a continuation-in-part of U.S. Pat. application Ser. No. 07/586,879 filed Sep. 24, 1990 and titled Article with Different Gloss Surfaces, now abandoned.

FIELD OF THE INVENTION

This invention relates generally to printing and more specifically, to a process of printing an article such as a magazine cover or the like to produce an article that has a high gloss finish in one region of the article and a low gloss finish in another region of the article.

1. Background of the Invention

The concept of printing an article with a high gloss finish, such as a magazine cover, is well known in the art. Typically, the printing ink contains a varnish to create a gloss finish on the surface of the article. After normal printing and drying of the article one applies an acrylic resin coating over the entire surface of the article. The acrylic resin coating provides two benefits. First, it hardens to provide a scuff and abrasion resistant film over the surface of the article and second, when dried it enhances the gloss finish on the surface of the article.

The present invention relates to a process where one can create two different and discrete gloss finishes on the surface of the article through control of the printing ink setting times and the timing of the application of the acrylic coating to the surface of the article.

The concept of printing inks in well known in the art. Typically, a printing ink contains a pigment for providing color, a vehicle for holding the pigment and other additives such as varnish to provide a gloss finish to the surface of the printed article.

In a typical prior art printing process, one applies an ink containing a vehicle, a pigment and a varnish. After application of the ink to the article, the ink is allowed to dry or set by passing the article through heating ovens and chill rollers. To protect the surface of the article during subsequent handling and to enhance the glossiness of the article one applies an acrylic coating over the entire surface of the article after the article has been heated and chilled.

In a typical four-color process, an article rapidly passes under multiple printing rollers, with each of the printing rollers applying a different colored ink to the article. After application of the various colored inks the inks are dried by heating and chilling. Next, one applies an acrylic coating over the entire surface of the article to provide an article with a uniform high gloss finish over the entire surface of the article.

The present invention utilizes the conventional printing process to print multiple inks on the surface of an article but differs in that at least one of the printing inks contains a drying retardant that cause one of the printing inks to dry at a substantially slower rate than the other printing inks. By application of the acrylic coating to the surface of the article having both a fast drying printing ink and a slow drying printing ink during the interval after the faster drying printing ink has dried but before the slower drying printing ink has completely dried one obtains an article having a surface with two discrete and different gloss finishes. That is, it has been discovered that by using printing inks that have different drying rates and then coating the entire article with a clear see-through resin such as an acrylic resin prior to at least one of the printing inks being completely dried one can produce discrete regions of different gloss finishes on the surface of the article in accordance with the state of the printing ink. The portion of the surface covered by the acrylic resin and the printing ink that is completely dry has a high gloss finish. The portion of the surface covered by the acrylic resin and the printing ink that is not completely dry has a duller finish.

2. Description of the Prior Art

U.S. Pat. No. 4,839,200 is directed to ink-jet printing of an aqueous base ink onto a recording medium which has been pre-printed with an oil-based printing ink by applying a water-soluble adhesive or glue layer onto the oil-based ink layer prior to the ink-jet deposition of the aqueous based ink layer.

U.S. Pat. No. 4,217,378 teaches a method for producing decorative and artistic effects on a plain surface by distorting the film with a source of heat.

U.S. Pat. No. 3,218,183 shows a coating cover for paper stock used in magazine covers or the like which contains a polyvinyl alcohol.

U.S. Pat. No. 2,230,876 teaches a coating process to protect and improve the appearance and strength of an article by applying a coat of vinyl acetate resin, applying a second coating solution of cellulose acetate which dries to a hard-gloss finish.

U.S. Pat. No. 4,170,681 teaches a method of disposal forming a varnish layer on the hydrophilic surface carrying areas of hydrophobic ink.

U.S. Pat. No. 2,000,347 discloses coating a paper stock with a cellulose coating of material.

U.S. Pat. No. 2,974,058 discloses the problems of coating printing inks and points out that it is necessary for printing inks to have dried before further lacquering coats are applied. The patent points out that the lacquering improves the gloss of the print, but that before the lacquering is applied, it is important to have the inks dry; otherwise bleeding occurs. The patent discloses a method in which a wet steam settable printing ink formed of a pigment of binder and binder solvent is coated with a film forming layer containing water in sufficient amount to precipitate the binder, thereby permitting one to coat the article before the ink is completely dry.

U.S. Pat. No. 2,696,168 discloses a method for printing that permits one to handle a printed article before the ink is completely dry with the advantage that the application of the coating while the ink is still wet permits faster processing. The solvent used in this particular film is such that it is sufficiently volatile that it will immediately dry with little or no heating.

BRIEF SUMMARY OF THE INVENTION

Briefly, the present invention comprises a method for producing an ink-printed article with two different and discrete gloss finishes by printing on the surface of the article with at least two printing inks with the printing inks having different drying rates and then applying a clear see-through coating such as an acrylic coating to the entire surface of the article containing the two inks prior to the complete drying of at least one of the printing ink but after substantial drying of the other printing ink to produce a gloss finish on the surface of the article in accordance with the state of dryness of the printing ink.

DESCRIPTION OF THE PREFERRED EMBODIMENT

Figure 1:
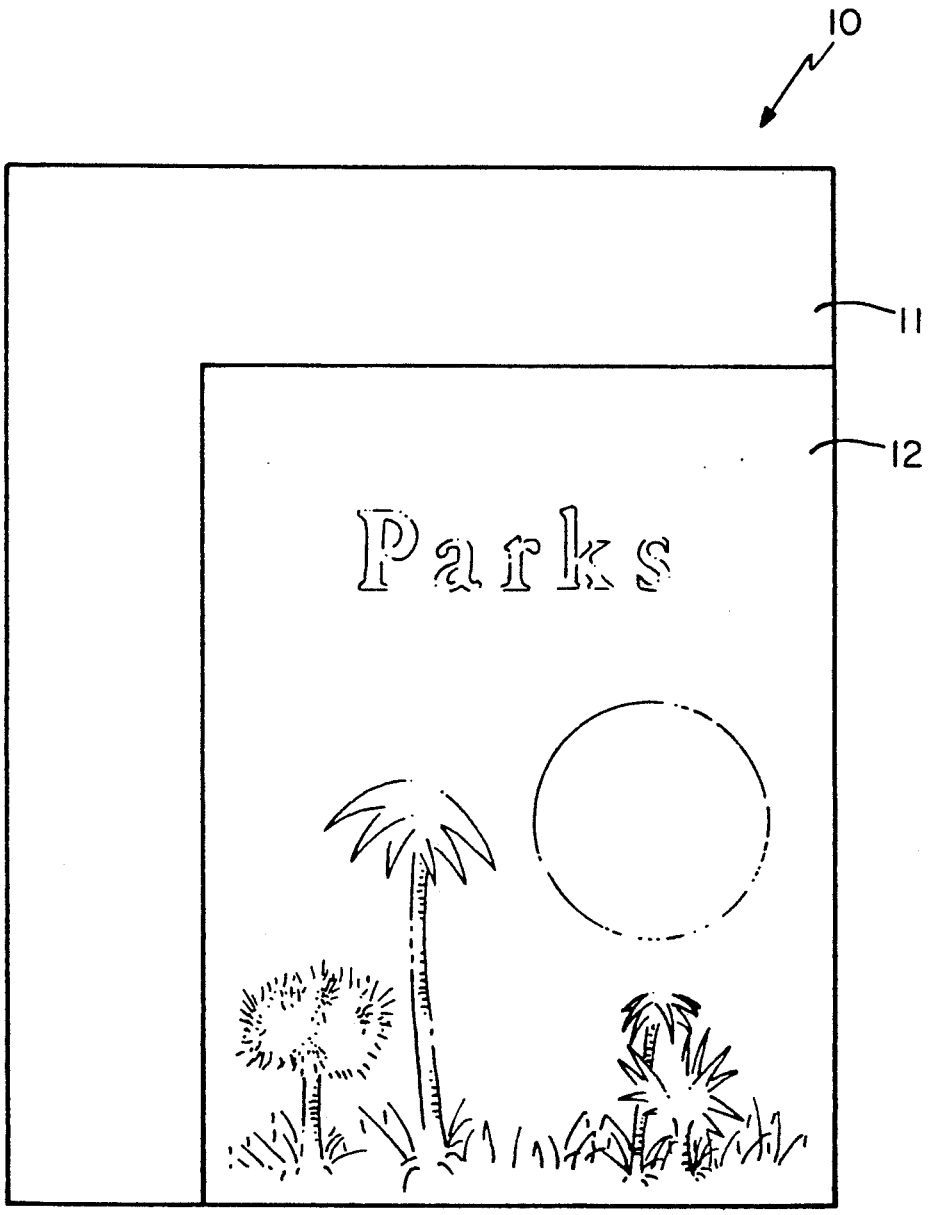
FIG. 1 shows a cover sheet for a magazine, having two different gloss finishes.

The sole figure shows a typical paper-stock article such as a magazine cover and is identified by reference numeral 10. Reference numeral 11 identifies a first L-shaped low gloss region border area containing a first printing ink and reference numeral 12 identifies a second rectangular shaped high gloss region containing multiple printing inks.

When one prints an article where the border region 11 has a dull finish and the main region 12 has a glossy finish the two contrasting gloss finishes produce a pleasing visual effect to the viewer. The present invention allows a user to produce discrete and different gloss finishes on an article without having to alter the normal printing run of the article. That is by using printing inks that have different drying times one can control the final state of glossiness on the finished article.

In order to produce article 10 with a duller gloss region in the border region 11 then in the main region 12 without alternating the normal printing run the operator selects printing inks having different drying rates. This may be accomplished by selecting printing inks with vehicles that have different drying or setting times. One of the ways of slowing down the drying rate of the ink is by use of inks with different varnishes. More directly it has been found that the tung oil or China wood oil used in the varnish is a drying retardant that has a substantial effect on the drying or setting time of the printing ink. By selecting a first printing ink containing a fast drying vehicle and a second printing ink containing a slower drying vehicle and then applying both printing inks to the surface of an article one obtains an article where for a period of time in one region of the article the ink is dry but in another region of the article the ink remains wet for an extended period of time. By applying an acrylic coating to the entire surface of the article during the period when one of the printing inks has dried but at least one of the printing inks has not dried one obtains a dull gloss finish in the region containing the slower drying printing ink and a high gloss finish in the region containing the dried printing ink. For example, in the article shown in FIG. 1 printing ink in region 11 typically contains a vehicle and a pigment with the vehicle containing a varnish having a drying retardant such as China wood oil. The second printing inks for the main region 12 also contain a vehicle and a pigment with a more rapid drying vehicle so that the second printing inks have a substantially faster drying time than the first printing ink applied to region 11. Typically a fast drying printing ink may be completely dry in a few seconds and a slower drying printing ink may not be completely dry for many minutes or hours. In the drying process of the present invention the article spends about one half second in the drying oven and only about two seconds for the entire process of inking, drying, chilling and coating of the article. Generally the ovens contain two heating zones, one drives off the moisture in the paper and the second flashes off the solvent in the ink.

EXAMPLE 1

In the process of printing a paper stock article, a first slow drying printing ink containing a first pigment and a slow drying vehicle including a varnish was applied to region 11. Next, four process colors (four printing inks, which comprise black, cyan, magenta, and yellow pigments all having faster drying rates than the first printing ink were applied to region 12. Next the article with the inked surfaces passed through a oven to dry or set the ink. After drying, the article was directed around chill rollers to cool the inks and the article. It should be pointed out that although the PMS printing ink and it's slower drying vehicle dried at a different rate than the four process color inks and their vehicle that no smearing of any of the inks occurred during the heating and chilling process. That is, all the inks had to dry or set to a point where the inks did not smear or smudge during a press run. Even though both printing inks had passed through a drying oven and a chiller without smearing, the ink in region 11, which had a longer drying time, did not completely dry or set during the curing and chilling process. During this post chilling period i.e., after the vehicles in the ink in region 12 had dried but before the vehicle in the ink in region 11 had dried, the operator applied an acrylic resin (Product No. 971-HC-0123 manufactured by AKZO Coatings Inc.) coating over both surfaces 11 and 12 and then allowed the acrylic coating to cross-link and harden under a source of ultraviolet lamps. In region 12 of the acrylic coated article 10 the fast-drying printing inks which had already dried prior to applying the acrylic coating produced the conventional high gloss finish in the border region 11 while the partially dried printing ink resulted in a low gloss appearance. Gloss measurements of the gloss finish on the article were made in accordance with the TAPPI test standard T480 and showed an average gloss reading of 91.6% in region 11. The main region 12 showed an average gloss reading of 95.3%. In the gloss readings a higher percentage reflects a high gloss finish (more light reflected) and a lower percentage represents a surface with less gloss finish (less light reflected).

EXAMPLE 2

The above example was repeated with two similar inks (ink A and ink B) except a different vehicle with a slower drying varnish was used for the ink in region 11. The results were more pronounced, ink A with the slower drying varnish had a gloss reading in region 11 of 69.8% and in region 12 with the faster drying varnish had a gloss reading of 99.9%. Using ink B with a slower drying varnish, the gloss reading was 73.7% in region 11 and with the faster drying varnish the gloss reading was 99.8% in region 12.

Further testing was conducted to determine the effect of the amount of varnish and the pigment in the ink on the gloss finish. Generally, by increasing the amount of pigment in the ink one decreased the amount of varnish and thus the amount of drying retardant that can be used in the printing ink. Consequently, with less drying retardant in the vehicle for the printing ink the difference in the glossiness in two regions becomes less pronounced. Since the effect of the amount of the pigment has an effect on the differences in the glossiness the use of lighter less pigmented inks with more varnish and thus greater amounts of drying retardant or inhibitors produces more discrete contrasting regions of glossiness. Consequently, by controlling the amount of the drying retardants in the ink and the state of dryness of the printing ink when applying the acrylic coating one generally obtained a gloss reading proportional to the state of dryness of the printing ink.

While it is apparent that controlling the drying rate or the state of dryness of the printing ink, one generally create a gloss reading proportional to the state of the dryness of the printing ink. However, to isolate the drying rate additional tests were conducted to directly measure the effect of the tung oil as a printing ink drying retardant. Printing inks with different amounts of tung oil by weight were tested to determine the gloss reduction between two regions, one which had a slow drying or setting printing ink and another which had more rapid drying printing inks. While many factors such as the speed of the press, temperature and humidity have an effect on the drying rate of the printing ink the following test results were conducted to isolate the effect of glossiness in accordance with the amount of China wood oil or tung oil used as the drying retardant in the printing ink.

EXAMPLE 3

A first fast drying ink and a second fast drying ink, both with no tung oil in, were used to establish a reference of the difference in gloss reduction due to the inherent differences in the two printing ink. Both inks were applied to a fast moving paper web (approximately speed of 650 feet per minute). After printing the two inks on the paper web the web was sent through a drying oven, a chiller and an acrylic applicator that applied the layer of acrylic over the entire surface of the article. Five different samples were selected and the gloss reading was measured at two different positions on each sample. The first position correspond to an area covered by printing ink A and the second position corresponded to an area covered by printing ink B. With substantially identical inks except for pigment, position 1 had an average gloss reading of 99.3, and position 2 had an average gloss reading of 95.2.

| SAMPLE NUMBER | INK A % REDUCTION POSITION 1 | INK B % REDUCTION POSITION 2 |
|---|---|---|
| 1 | 98.1 | 91.2 |
| 2 | 101.3 | 97.0 |
| 3 | 98.8 | 95.2 |
| 4 | 100.1 | 96.2 |
| 5 | 98.3 | 96.4 |
| Average | 99.3 | 95.2 |

The gloss readings represented the inherent gloss differences between an article printed on the same paper stock with two printing inks with different pigments.

EXAMPLE 4

The process used in example 3 was repeated except that four percent by weight of tung oil was added to printing ink A and printing ink B had no added tung oil. Again, the gloss readings were taken at two positions on each of five articles.

| SAMPLE NUMBER | INK A % REDUCTION POSITION 1 | INK B % REDUCTION POSITION 2 |
|---|---|---|
| 1 | 97.4 | 93.9 |
| 2 | 96.4 | 97.0 |
| 3 | 96.0 | 95.1 |
| 4 | 98.0 | 98.3 |
| 5 | 97.3 | 96.0 |
| Average | 97.0 | 96.1 |

Although there was an actual gloss reduction from example 3 to example 4 there was no effective difference between the two positions on the same article since the inherent difference in inks was apparently greater than the effect of the added tung oil.

EXAMPLE 5

The process used in example 3 was repeated except that 8 percent by weight of tung oil was added to printing ink A. Again, the gloss readings were taken at two positions on the same article.

| SAMPLE NUMBER | INK A % REDUCTION POSITION 1 | INK B % REDUCTION POSITION 2 |
|---|---|---|
| 1 | 93.1 | 97.9 |
| 2 | 92.7 | 98.2 |
| 3 | 93.5 | 96.4 |
| 4 | 93.6 | 99.0 |
| 5 | 93.7 | 98.3 |
| Average | 93.3 | 97.9 |

Although there was an actual gloss difference between position 1 and position 2 a visual comparison between the two positions revealed little perceived difference in gloss coatings between the two positions.

EXAMPLE 5

The process used in example 3 was repeated except that 23 percent by weight of tung oil has been added to printing ink A. Again, the gloss readings were taken at two different positions on the same article.

| SAMPLE NUMBER | INK A % REDUCTION POSITION 1 | INK B % REDUCTION POSITION 2 |
|---|---|---|
| 1 | 55.3 | 95.7 |
| 2 | 56.3 | 98.8 |
| 3 | 55.3 | 98.8 |
| 4 | 56.1 | 98.4 |
| 5 | 55.9 | 98.8 |
| Average | 55.8 | 98.1 |

There was a substantial actual gloss reduction in position 1 and a visual comparison between the two positions on each of the samples readily showed that position 1 had a dull finish and position 2 had a glossy finish. The results indicate that as the amount of tung oil and consequently the amount of retardant for the drying of the ink increases, the gloss reduction increases proportionally. At the lower gloss reduction, differences in visual appearance are less pronounced; however, as the amount of tung oil increases, the difference in gloss reduction becomes more pronounced.

It should be pointed out that the above examples were run on a press on which there was an elapsed time of approximately two seconds between the application of the printing inks and the acrylic coating. If the elapsed time is greater, the differences in gloss reduction would diminish. Conversely, if the elapsed time between application of the printing ink and application of the acrylic coating were increased, one might expect a more pronounced effect in gloss reduction.

Although the acrylic coating of articles to produce gloss finishes over the entire surface of an article is well known in the art the actual mechanism in the present invention on how the gloss finish varies in accordance to the state of the printing ink and the state of dryness of the printing ink containing a varnish is not fully understood. It is believed that as the varnish in the ink dries it forms an outer film that dries downward toward the paper stock. It is believed that if the varnish in the ink is not completely dry the application of the acrylic resin coating over the varnish has the effect of softening and redissolving the partially dried top surface of the varnish film so that the region where the varnish has not completely dried has a rough and irregular finish that looses its gloss as a result the acrylic resin coating curing on a nonstable varnish base.

Also while tung oil (also known as China-wood oil) as an ingredient of a printing ink vehicle has been isolated as having a significant effect on the drying rate of the varnish other vehicles which retard the drying of the printing ink which are compatible with the printing ink and the stock of the finished could also be used.

Figure 2:
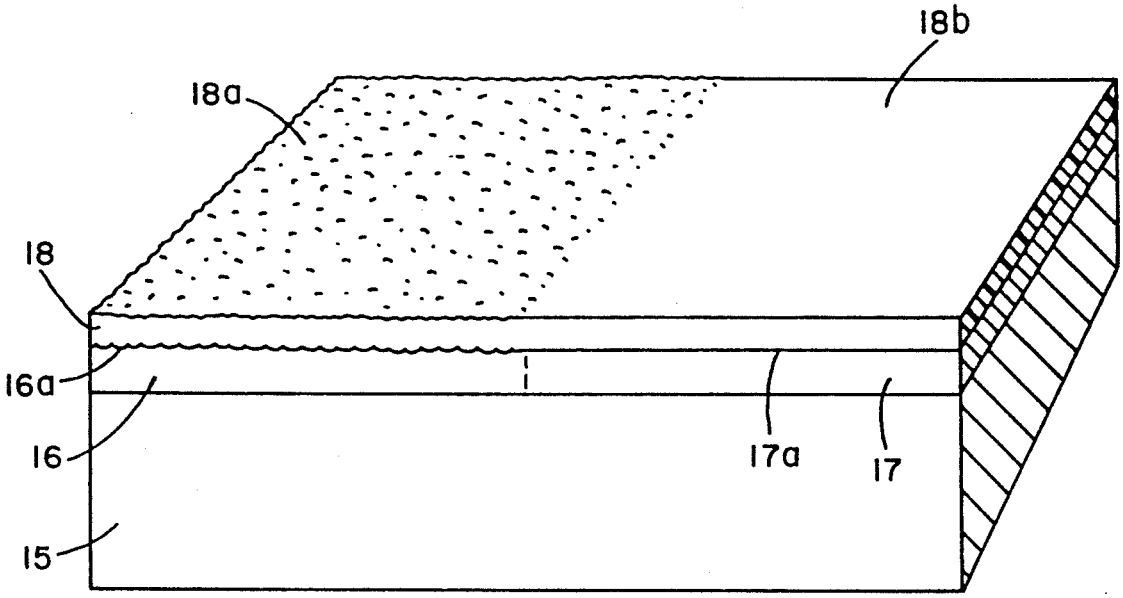
FIG. 2 shows an enlarged cross sectional view of a portion of the cover sheet of FIG. 1.

FIG. 2 illustrates the physical effects of an article with two different and discrete gloss finishes on the surface of the article. The article comprises a paper stock 15 with a first slow drying printing ink 16 located on one region of paper stock 15 and a second faster drying printing ink 17 located on a second region of paper stock 15. Located extending over both printing inks 16 and 17 is a single continuous abrasion coating 18 of acrylic resin. Note the printing ink 16 dried with an irregular top surface 16*a* and the faster drying printing ink 17 dried with a smooth surface 17*a*. Located above both ink 16 and ink 17 is the continuous coating 18 of clear acrylic resin. The acrylic resin coating 18 has two distinct regions a first irregular surfaced region 18*a* located above the irregular top surface 16*a* and a second smooth surface region 18*b* located above printing ink 17. The irregular surface of region 18*a* contains many irregularities that scatter and diffuse the light to produce a finish that appears dull to the views eye. In contrast the region 18*b* includes a smooth finish that reflects light back to the viewer to appear as a glossy finish that is visually different in glossiness to the viewers eye than the region 18*a*.

Figure 3:
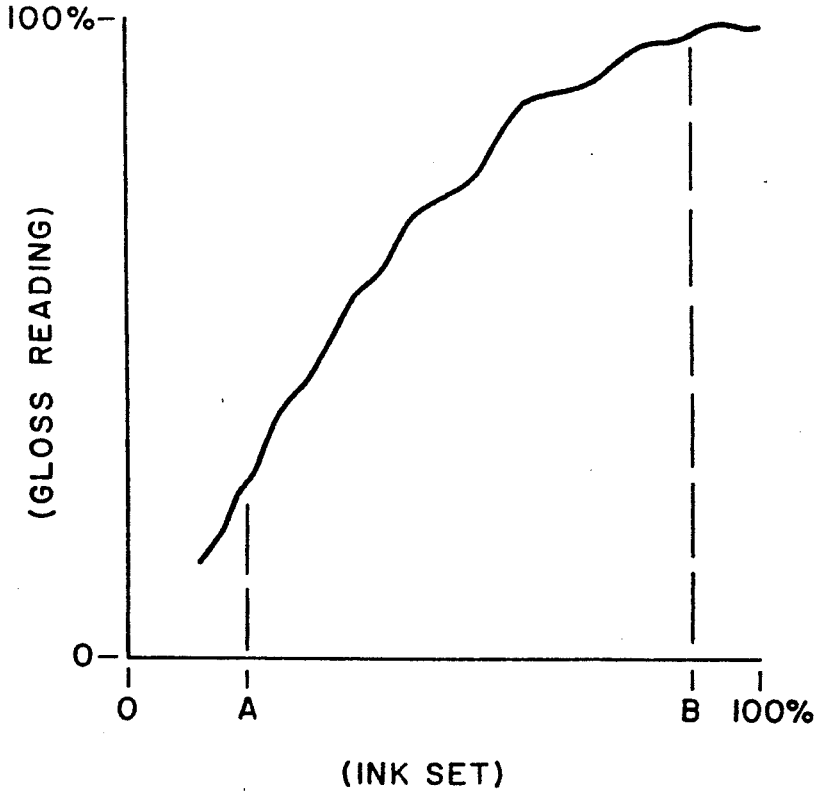
FIG. 3 shows a schematic graph of the general relationship of the gloss reading as a function of the state of the ink during the application of the acrylic coating.

Without attempting to quantify the relationship FIG. 3 illustrates in general the relationship between the state of dryness or setting of the printing ink and the gloss finish for a particular printing ink used to print an article. In general the printing ink used in our process must be sufficiently dry so that the printing ink does not smear or smudge during the application of the acrylic coating. This would correspond to point A on the graph. If the printing ink is dry or substantially dry during the application of the acrylic coating as indicated by point B the gloss finish would be at or near a maximum gloss finish.

It should be understood that where the present invention provides for two discrete gloss finishes on an article it is apparent that by using three or more inks each with different drying times the printed article can be printed with regions of multiple gloss finishes.

We claim:

1. A method of making at least two different and discrete gloss finishes on the surface of a printed article by applying inks to the surface of an article comprising the steps of:

applying a first printing ink having a first drying time to a first portion of the surface of the article;

applying a second printing ink having a second drying time shorter than the first drying time of said first printing ink to a second portion of the surface of the article; and then applying an acrylic coating to the first and second portions of the article covered with the first and second printing inks after both inks are sufficiently dry so as not to smear or smudge but before the first printing ink is dried and after the second printing ink has dried sufficiently so that the first portion of the surface of the article having the slower drying first printing ink dries with a gloss finish that is duller than the gloss finish of the second portion of the article having the faster drying second printing ink.

2. The method of claim 1 wherein the acrylic coating is applied after the second printing ink is completely dried.

3. The method of claim 1 wherein the acrylic coating is applied to the article before the the second printing ink is completely dried to thereby produce an article with different gloss finishes.

4. The method of claim 3 wherein the article with printing inks thereon is passed through an oven to heat the printing inks prior to coating the surface of the article with the acrylic resin.

5. The method of claim 4 wherein the article with the printing inks thereon is passed through chilling rollers to cool the article prior to coating the surface of the article with an acrylic resin.

6. A method of making at least two different and discrete gloss finishes on the surface of an article by applying inks with different drying rates to the surface of an article comprising the steps of:

applying a first printing ink having a first drying rate to a first portion of the surface of the article;

applying a second printing ink having a second drying rate to a second portion of the surface of the article, said second drying rate substantially faster than said first drying rate so that there is a post ink application period where the second printing ink is drier than the first printing ink but both of said printing inks are sufficiently dry so as not to smear or smudge; and then during the post ink application period applying an acrylic coating to the first portion of the article covered with the first printing ink and to the second portion of the article covered with the second printing ink thereby causing the acrylic coating over the first portion of the surface of the article having the first printing ink to dry with a first gloss appearance and the acrylic coating over the second portion of the article having the second printing ink with the faster drying rate to dry with a second gloss appearance that is glossier than the first gloss appearance.

7. The method of making an article having a contiguous coating with at least two regions with a different gloss finish in the coating comprising:

applying a first printing ink having a first drying rate to a portion of the surface of a base member;

applying a second printing ink having a second drying rate faster than said first drying rate to a further portion of the surface of a base member;

drying said first printing ink and said second printing ink until both said first printing ink and said second printing ink are sufficiently dried so as not to run or smudge;

applying a clear see-through top coating to said first printing ink and said second printing ink; and curing said clear see-through top coating when said first printing ink is in less of a cured state than said second printing ink to thereby produce a first light reflecting surface over said first printing ink and a second light reflecting surface over said second printing ink that is glossier than said first light reflecting surface so that a viewer perceives the surface of the article as having two distinct and discrete gloss finishes.

8. The method of claim 7 including adding tung oil to said first printing ink to retard the drying rate of said first printing ink.

9. The method of claim 7 including adding at least 8 percent by weight of tung oil to said first printing ink to retard the drying rate of said first printing ink.

* * * * *